United States Patent [19]

Sedlak

[11] Patent Number: 5,058,248

[45] Date of Patent: Oct. 22, 1991

[54] COFFIN

[76] Inventor: Werner Sedlak, Waldbach 75, Walbach, Austria, A-8253

[21] Appl. No.: 519,049

[22] Filed: May 4, 1990

[30] Foreign Application Priority Data

Dec. 6, 1989 [AT] Austria ..... 2780/89

[51] Int. Cl.[5] ..... A61G 17/00

[52] U.S. Cl. ..... 27/4; 27/16; 27/17; 27/35

[58] Field of Search ..... 27/4, 1, 2, 14, 16, 27/17, 35

[56] References Cited

U.S. PATENT DOCUMENTS

| | | | |
|---|---|---|---|
| 629,090 | 7/1899 | Peoples | 27/4 |
| 641,377 | 1/1900 | Dunlap | 27/4 |
| 706,398 | 8/1902 | Ernst | 27/4 |
| 930,543 | 8/1909 | Hahn | 27/4 |
| 3,969,798 | 7/1976 | Sahlin | 27/4 |

*Primary Examiner*—Richard E. Chilcot, Jr.

*Attorney, Agent, or Firm*—Townsend and Townsend

[57] ABSTRACT

A coffin consists of a trough (1) and of a lid (2) which can be placed onto the trough (1). All elements (3 to 7) forming the trough (1) and all elements (8 to 12) forming the lid (2) are pivotably interconnectred to each other by means of hinge means (13), so that these elements can be swivelled down so that they lie in a common plane for facilitating storage and transportation of the coffin. In the position of use these elements are interconnected to each other by means of clamping elements (14).

8 Claims, 4 Drawing Sheets

COFFIN

FIELD OF THE INVENTION

The invention relates to a coffin, comprising a trough for receiving the dead body and a lid to be placed onto the trough, said trough consisting of at least one bottom wall member, at least one head wall member, at least one foot wall member and at least two side wall members, said lid consisting of at least one upper wall member, at least one head wall member, at least one foot wall member and at least two side wall members.

Within usual coffins the several wall member of the trough as well as of the lid are rigidly connected to each other. This has the disadvantage that storing and transportation of the empty coffins is considerably room-consuming.

Many people living abroad wish to be buried in a coffin consisting of home wooden material, because after their desease transportation of the dead body to the home country is difficult, particularly due to the high costs. However, the costs of transportation into a foreign country of a coffin consisting of wall members rigidly interconnecting to each other and made of home wooden material are also considerable.

DESCRIPTION OF THE PRIOR ART

From the Western German utility model specification 8504155.7 a collapsible coffin has become known which consists of cut-out plates provided with trapezoid-shaped mountings for connecting adjoining plates, which connection is easy to loose. Such a coffin can be disassembled in its elements which considerably reduced the volume necessary for transportation, however mounting of the several cut-out plates is difficult and the coffin has a bad appearance. However, a good appearance of the coffin is desired just by those people which are willing to accept additional costs in order to be buried within a coffin consisting of home wooden material. Further, the gaps between adjoining cut-out plates cannot be tightened within this known coffin. However, a tigthness of these gaps is of importance particularly then, if the dead body must rest a considerable time within the coffin before being buried.

SUMMARY OF THE INVENTION

It is an object of the invention to avoid the disadvantages of the known collapsible coffin and to provide a coffin which is so constructed that its transportation volume is considerably reduced when compared with a coffin consisting of wall members rigidly connected to each other. Further, it is an object of the invention to improve the coffin so that its single elements can be brought into their position of use without any difficulty. It is another object of the invention to improve the coffin so that it has a nice appearence.

The invention solves this task and consists in that the bottom member as well as the upper wall member are connected for pivoting motion with its respective head wall members, its respective foot wall members and its respective at least two side wall members by means of hinge members so that all these elements can be turned down in a common plane and that the head wall members and the foot wall members of the trough as well as of the lid can be connected to the respective at least two side wall members in the position of use by means of clamping elements. By the use of hinge members it is now possible to pivote the head wall members, the foot wall members and the side wall members of the trough so that they are brought into a position in which they lie into the plane of the bottom members, and that the head wall members, the foot wall members and the side wall members of the lid can be swivelled so that these members lie in a common plane with the plane of the upper members of the lid. The members forming the trough and the members forming the lid can then be piled up and are then preferably packed, the resulting package having small dimensions so that the space necessary for transportation and thereby the costs for transportation can be kept low. Even if the inventive coffin must not be transported a long distance, the inventive coffin has the advantage that the space necessary for storage of the coffins can be decreased considerably so that no big store houses are more necessary. When the inventive coffin has to be brought into its position of use it is only necessary to swivel the head members, foot members and the side wall members of the trough as well as of the lid for such an extent that they contact each other at the points of contact provided, and then to interconnect these members by the clamping elements which press the single elements together so that a tight connection is ensured. This tight connection of the single elements can be further improved by providing sealing elements at the points of connection between the single elements, which sealing elements are anchored in one of the two elements contacting each other and sealingly engage the other of the two elements contacting each other in the position cf use. For example, such sealing elements may consist of rubber or synthetic plastics material and may have hollow profile comprising a flange protruding therefrom, which flange is anchored in a groove. By such an anchoring it is ensured that the sealing elements cannot he become lost and that the sealing elements are always kept in the correct position of use.

For the hinge elements there may be used, for example, those hinge elements which are common in use for doors of furniture elements and which allow to be swivelled for an angle of 180° and which are not visible in the position of use of the single elements of the trough or of the lid, respectively, so that the hinge elements to not disturb the appearence of the coffin. In order to avoid that the clamping elements do disturb the appearance, the clamping elements according to a further feature of the invention are covered by cover means fixed to the inner side of the head members and/or of the foot members and/or of the side wall members. Preferably, these cover means are plates extending over the total inner surface of the head member and/or of the foot member and/or of the side wall members and preferably are provided with a padding. The plates of the cover means preferably are kept spaced apart from said inner surface by means of spacer elements so that the clamping elements can be provided within the space between said inner surface and the plates. The preferably upholstered plates provide for a good appearance also of the inner side of the coffin.

It is of advantage to connect the cover means by means of snap catch means to the head member and/or to the foot member and/or to the side wall members, which snap catch means also may be positioned within the interspace formed by the spacer elements.

According to a preferred embodiment of the invention the clamping elements comprise an excenter closure means, the position of the closure member being adjustable, for example by means of screw threads so that the connection can be mounted in an easy manner, reliably and rigidly.

Frequently it is desired to enable one to look at the dead body positioned within the coffin without having the necessity to open the lid. In order to enable this, according to the invention the upper wall member of the lid is provided with a transparent insert member, preferably consisting of glass, which insert member can be closed by a plate which is fixed to the upper wall member for a swivelling motion, but can be fixed into its closed position so that before the funeral the transparent insert member is covered so that it cannot be damaged by clods or the like.

BRIEF DESCRIPTION OF THE DRAWINGS

In the accompanying drawings the invention is schematically shown by way of an example of a preferred embodiment.

Figure 1:
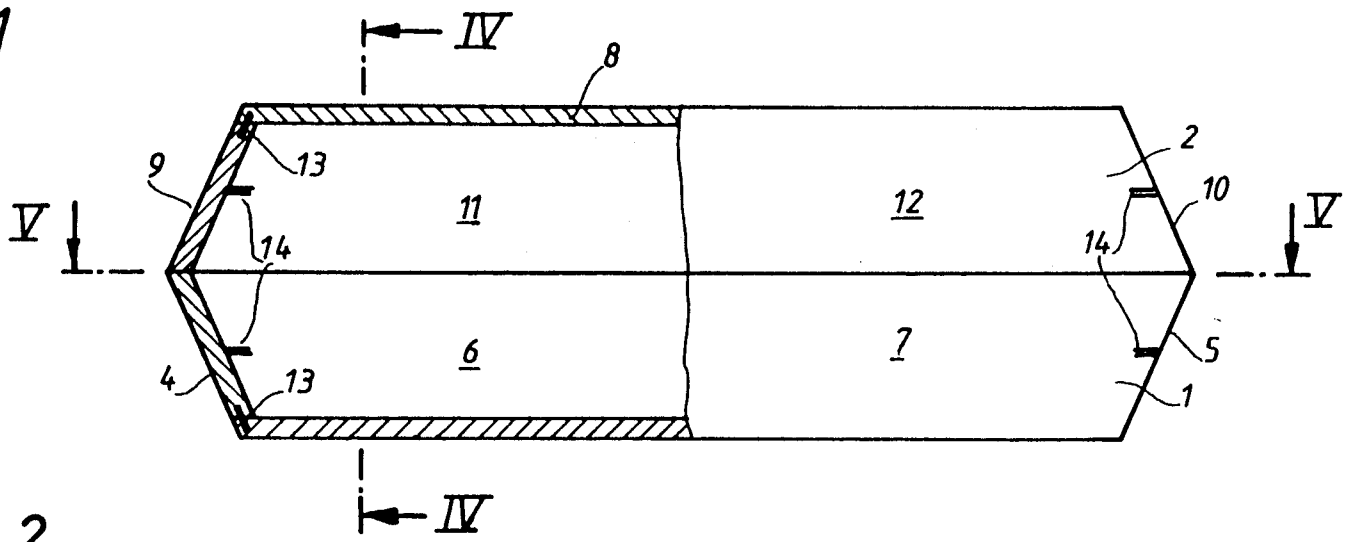
FIG. 1 shows an inventive coffin in side elevation, partially in section.

DETAILED DESCRIPTION OF A PREFERRED EMBODIMENT:

The inventive coffin comprises a trough 1 and a lid 2 which can be placed onto the trough i. The trough 1 comprises one single bottom wall member 3, one single head wall member 4, one single foot wall member 5 and two side wall members 6,7. In an analogous manner the lid 2 consists of one single upper wall member 8, a head wall member 9, a foot wall member 10 and two side wall members 11,12.

Figure 2:
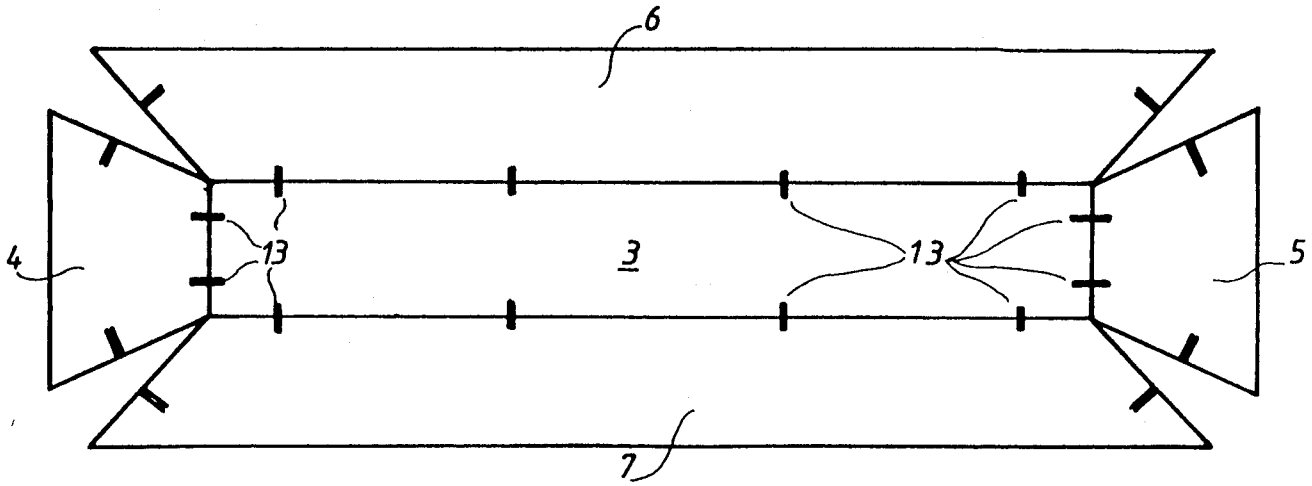
FIG. 2 shows the trough of the coffin into its transport position in which all elements forming the trough lie substantially in a common plane.

The head wall member 4, the foot wall member 5 and the two side wall members 6,7 of the trough 1 are connected to the bottom wall member 3 by hinge members 13 which are only schematicalls shown, so that all these members can be pivoted in a common plane, as this is shown in FIG. 2. In an analogous manner the members 9,10,11,12 of the lid 2 are connected by means of hinge members 13 to the upper wall member 8, so that al of these members can also be swivelled in a common plane. In the position of use of the several elements of the trough 1 as well as of the lid 2, which position is shown in FIG. 1 and in FIGS. 3 to 5, the head wall members 4 or 9, respectively, the foot wall members 5 or 10, respectively, and the side wall members 6,7 or 11,12 respectively, are pressed together by clamping elements 14 shown in FIGS. 1 and 2 only schematically.

Figure 3:
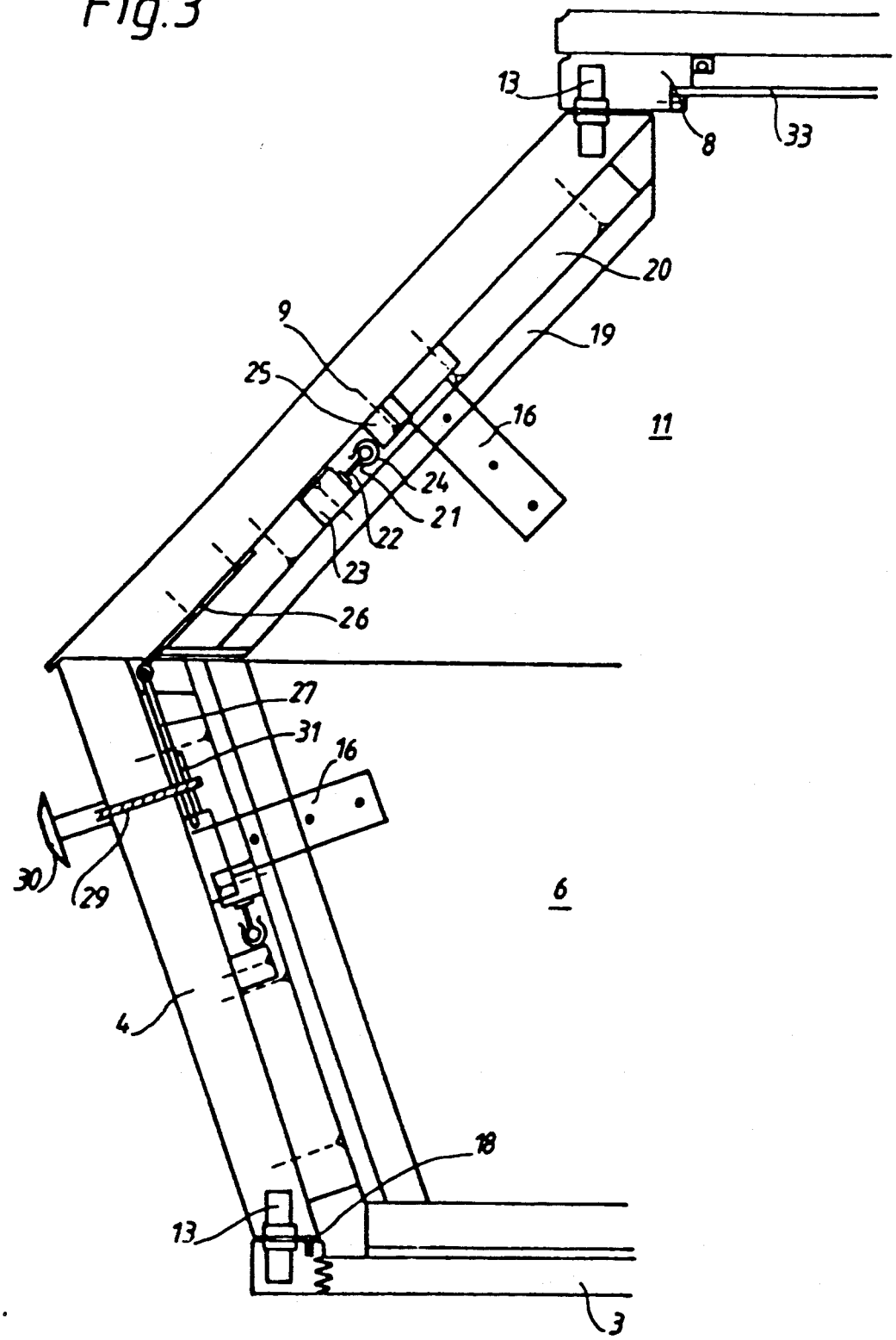
FIG. 3 shows a section throuth the head end of the coffin, seen in longitudinal direction of the coffin, in an enlarged scale.
Figure 4:
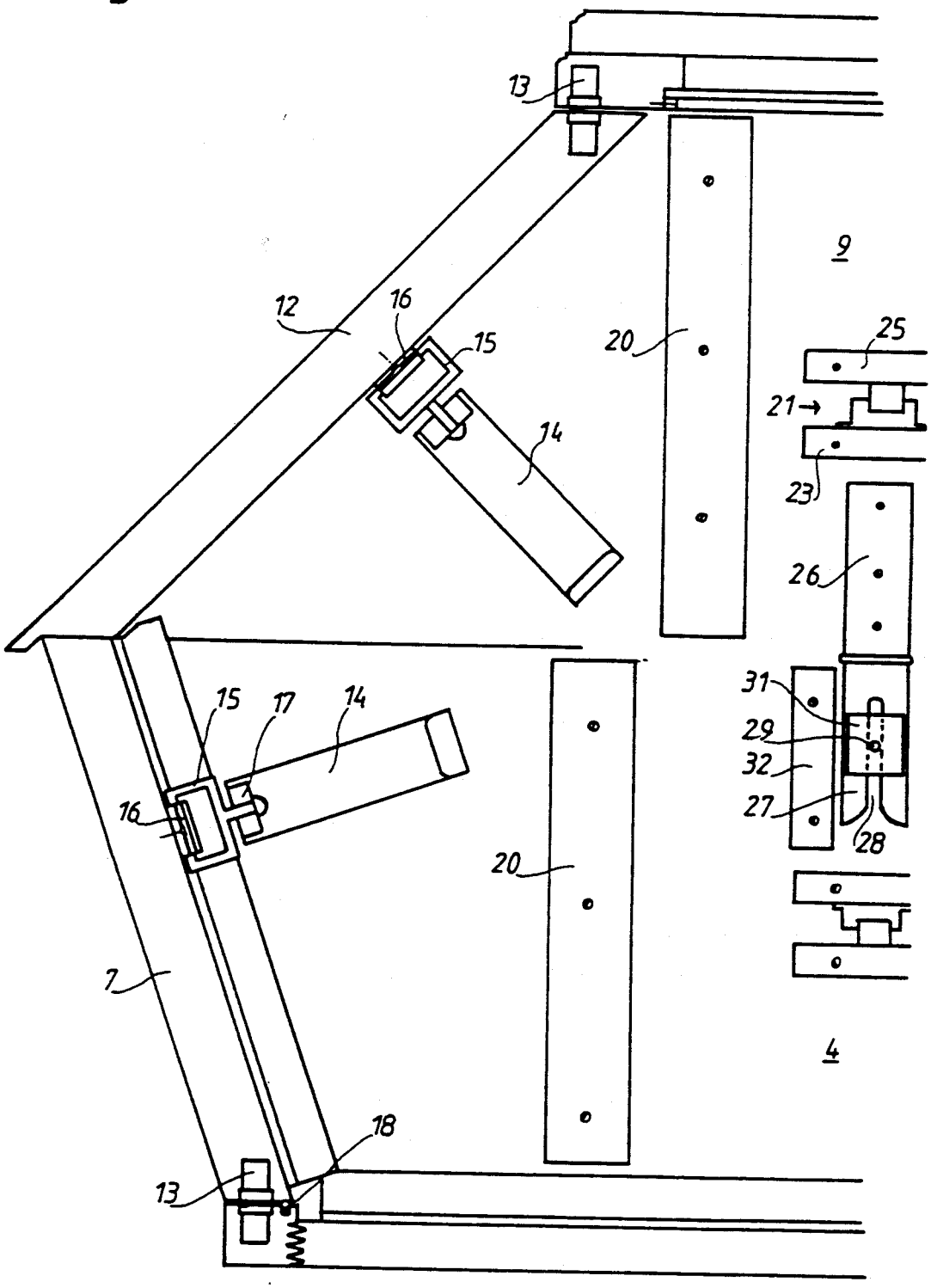
FIG. 4 shows a cross section through the coffin along the line IV—IV of FIG. 1, in an enlarged scale, the cover means on the inner side being removed.
Figure 5:
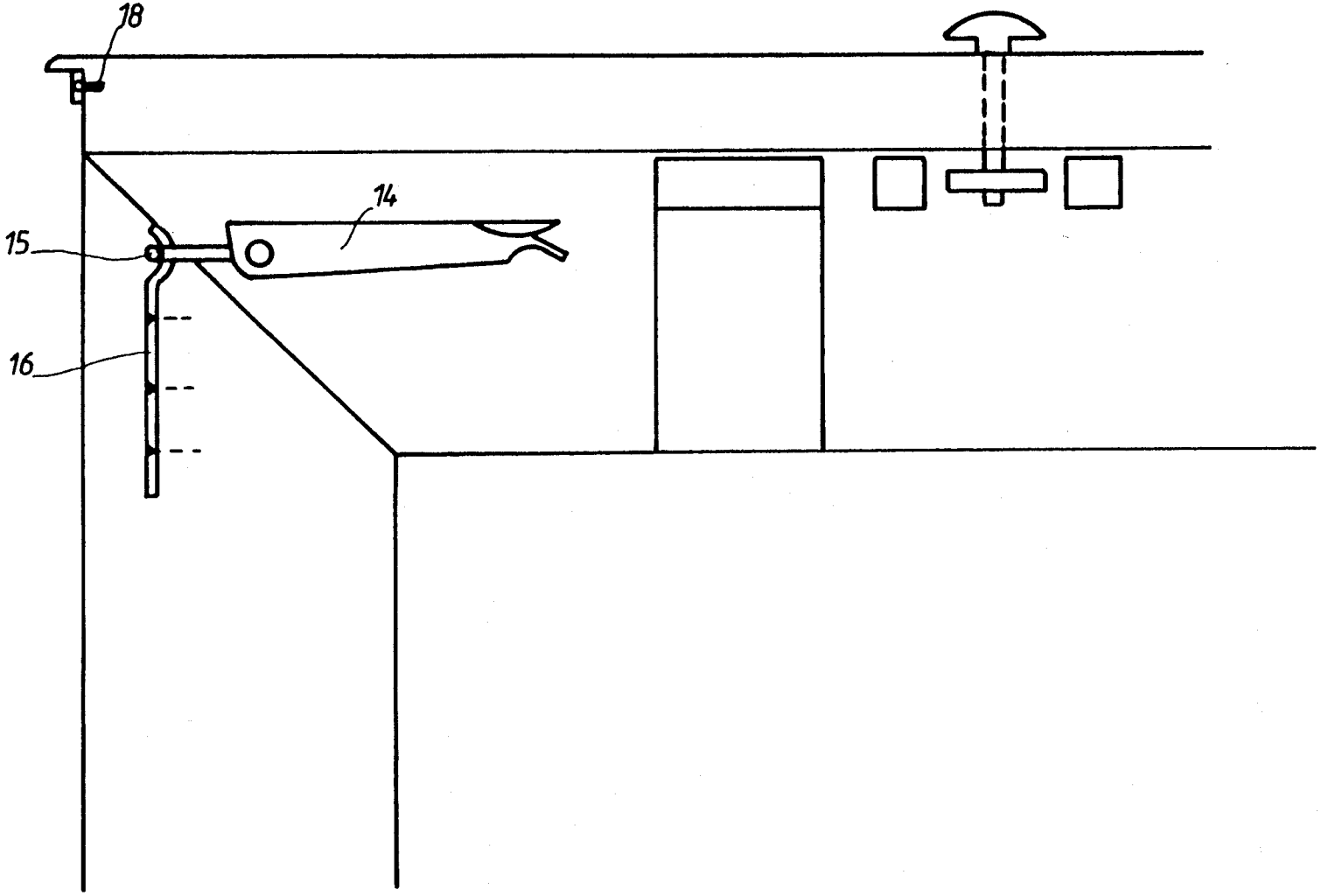
FIG. 5 shows in an enlarged scale a top plan view onto a corner of the trough of the toffin along the line V—V of FIG. 1.

As it can be seen for example from the FIGS. 3 and 4, the hinge members 13 are so embedded into the surfaces contacting each other of the elements pivotably interconnected, that they cannot be seen in the position of use of the single elements. Each clamping element 14 comprises an excenter closure fixed to one of the two elements to be interconnected, which closure is provided with an eye which can be hooked into an hook 16 fixed to the other of the two elements to be connected. The eye 15 is connected to the excenter closure by means of a screw thread 17 so that the position of the eye 5 relatively to the hook 6 can be adjusted, whereby one is enabled to rigidly clamp the elements together.

In order to provide for a reliable tightening between the several elements, sealing means 18 are provided which have a hollow profile and a flange protruding therefrom, which flange is anchored in a groove of one of the two elements 3 to 12 so that it cannot be loosened, the hollow profile sealingly contacting the other, neighbouring element.

In order to cover the clamping elements 14 plates 19 are provided on the inner surfaces of the head wall members 4,9, of the foot wall members 5,10 and of the side wall members 6,7,11 and 12, which plates 19 are kept spaced apart from the inner surface of the said elements by spacer elements 20 fixed to this inner surface, so that the clamping elements can be positioned within the interspace so formed. Within this interspace also snap closure members 21 for fastening of the plates 19 may be provided. Each snap closure member consists of an element 22 having a thickened end, which element is connected with the plate 19 by means of a ledge 23, and of an elastic member 24 surrounding the thickened end, which element 24 is connected to the inner side of the head wall member 4,9, of the foot wall member 5,10 or of the side wall member 6,7,11,12, respectively, by a ledge 25. The plates 19, therefore can be slipped into the interspace from the open end of the trough or of the lid, respectively, until the snap closure 21 engages, they are then reliably fixed.

The plate 19 may be provided with an upholstery or padding, particularly consisting of a foamed material provided with a slip. Thereby not only gaps eventually occurring between plates neighbouring each other can be compensated, but also a good appearance of the interior of the coffin is achieved.

In the interspace between the plate 8 and the head wall member 4,9 and the foot wall member 5,10 also a closure is positioned by means of which the lid 2 can be fixed to the trough 1.

This closure consists of a metal strip hinge means, the one element 26 is rigidly connected to the head wall member 9 or to the foot wall member 10, respectively, of the lid 2, and the other member 27 thereof is provided with a longitudinal slot 28 intersected by a threaded pin 29 which is provided with a handle 30 for rotation, which handle is positioned on the outer side of the trough. A small plate 31 has screw threads and is threaded therewith onto the screwed pin 29, which plate 31 contacts the member 27 of the metal strip hinge member, which element faces the interior of the coffin. By rotation of the screwed pin 28 by means of the knob-like handle 30 the member 27 is pressed onto the inner wall of the head wall member 4 or the foot wall member 5, respectively, of the trough 1.

In order to avoid that, when the screwed pin 20 is rotated, the small plate 30 is rotated also, stop ledges 32 are provided on the inner surface of the head wall member 4 or the foot wall member 5, respectively, of the trough 1.

In order to enable one to have a look onto the dead body when the lid 1 is closed, an insert 33 consisting of glass is provided on the upper wall member 8, which insert 33 can be covered by a plate 34 which can be fixed to the upper wall member 8. This plate 34 is pivotable connected to the upper wall member 8 by means of a hinge positioned on one of the longitudinal edges of the plate 34. On the opposing longitudinal edge, the plate 34 can be fixed to the upper wall member 8 in its closure position, preferably by any known fixing means, for example by a ball snap closure means.

What is claim is:

1. A coffin, having a trough for a dead body and a lid for closing said trough, said trough having at least five trough components including at least one bottom wall member with a perimeter contacting region, at least one head wall member with a first edge, at least one foot wall member with a first edge and at least two side wall members, each with a first edge, said lid having at least five lid components, including at least one upper wall member with a perimeter contacting region, at least one head wall member with a first edge, at least one foot wall member with a first edge and at least two side wall members, each with a first edge, comprising:

first hinge means for pivotally connecting the bottom wall member of the trough with the head wall member of the trough, the foot wall member of the trough and the side wall members of the trough, so that said head wall, foot wall, and two side wall members of the trough can be swivelled into a common plane with said bottom wall to form a flat configuration of said trough;

second hinge means for pivotally connecting said upper wall member with the head wall member of the lid, the foot wall member of the lid and the side wall members of the lid, so that said head wall, foot wall, and two side wall members of the lid can be swivelled into a common plane with said upper wall to form a flat configuration of said lid;

said first hinge means including a first plurality of hinges permitting movement of said head wall member, foot wall member and side wall members of said trough from said flat configuration of said trough to a position-of-use configuration wherein said edges of said head wall, foot wall and two side wall members of said trough are contacting regions, in contact with said perimeter contacting region of said bottom wall member and each of said first plurality of hinges is positioned between said edges of said trough components and said perimeter contacting region of said bottom wall member so that said first plurality of hinges are not visible when said trough is in said position-of-use configuration;

said second hinge means including a second plurality of hinges permitting movement of said head wall member, said foot wall member and said side wall members of said lid from said flat configuration of said lid to a position-of-use configuration wherein said edges of said head wall, foot wall and two side wall members of said lid are contacting regions, in contact with said perimeter contacting region of said upper wall member, and each of said second plurality of hinges is positioned between said edges of said lid components and said perimeter contacting region of said upper wall member so that said second plurality of hinges are not visible when said lid is in said position-of-use configuration;

first clamping means affixed to the inner side of said trough components for connecting said head wall member of the trough and said foot wall member of the trough with the two side wall members of the trough to maintain said trough in said position-of-use configuration;

second clamping means affixed to the inner side of said lid components for connecting said head wall member of the lid and said foot wall member of the lid with the two side wall members of the lid to maintain said lid in said position-of-use configuration; and first sealing elements provided at said contacting regions between said trough components and second sealing elements provided at said contacting regions between said lid components, said first and second sealing elements being anchored in one of two said components contacting each other and sealingly engaging the other of said components when said trough and said lid are in said position-of-use configuration.

2. Coffin as claimed in claim 1, further comprising cover means fixed to the inner side of at least one of the elements selected from the group comprising said head wall members, said foot wall members and said side wall members.

3. Coffin as claimed in claim 2, wherein said cover means comprise plates extending over the total inner surface of at least one of the elements selected from the group comprising said head wall members, said foot wall members and said side wall members, and further comprising spacer elements keeping said plates spaced apart from said inner surface.

4. Coffin as claimed in claim 3, wherein said plates are provided with an upholstery.

5. Coffin as claimed in claim 2, wherein said cover means are fixed to at least one element selected from the group of elements comprising said head wall members, said foot wall members and said side wall members by means of snap catch means.

6. Coffin as claimed in claim 1, wherein said clamping means comprise an excenter closure means having a closure member, said closure member being adjustable.

7. Coffin as claimed in claim 1, wherein said closure member is adjustable by means of at least one screw thread.

8. Coffin as claimed in claim 1, wherein said upper wall member of said lid is provided with a transparent insert member, and further comprising a plate for covering said insert member, said plate being pivotably fixed to said upper wall member, locking means being provided for keeping said plate in its closure position.

* * * * *